US006970657B2

(12) United States Patent
Suenaga et al.

(10) Patent No.: US 6,970,657 B2
(45) Date of Patent: Nov. 29, 2005

(54) IMAGE FORMING APPARATUS AND METHOD FOR CONTROLLING IMAGE FORMING APPARATUS

(75) Inventors: Takenori Suenaga, Hachioji (JP); Naoto Tokutake, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 99 days.

(21) Appl. No.: 10/850,472

(22) Filed: May 19, 2004

(65) Prior Publication Data

US 2005/0019046 A1 Jan. 27, 2005

(30) Foreign Application Priority Data

Jul. 23, 2003 (JP) ..... 2003-200351

(51) Int. Cl.[7] ..... G03G 15/08
(52) U.S. Cl. ..... 399/27; 399/61; 399/254; 399/256; 399/263; 73/290 V
(58) Field of Search ..... 399/27, 61, 254, 399/256, 263; 73/290 V

(56) References Cited

U.S. PATENT DOCUMENTS 5,036,363 A * 7/1991 Iida et al. ..... 399/30
6,539,182 B2 * 3/2003 Friedrich ..... 399/27

FOREIGN PATENT DOCUMENTS

JP 63088577 A * 4/1988 ..... G03G 15/08

* cited by examiner

*Primary Examiner*—Arthur T. Grimley
*Assistant Examiner*—Peter Lee
(74) *Attorney, Agent, or Firm*—Squire, Sanders & Dempsey

(57) ABSTRACT

An image forming apparatus includes: a developing device; a container for containing developer; a developer detector for outputting an output signal corresponding to presence or absence of developer, the developer detector being attached to a wall surface of the container so that a detector plane faces toward inside of the container; an agitating device for sliding on the detector plane of the developer detector and for agitating developer in the container; a controller for controlling a movement speed of the agitating device so that a relation between rise time T0 required for rise of the output signal outputted from the developer detector and time T1 when the agitating device covers the detector plane of the developer detector meets T0>T1.

8 Claims, 3 Drawing Sheets

DETECTED VALUE
PRESENCE
ABSENCE
ELAPSED TIME
t1
t2
t3
t4
t5
T0
T1
T0'

DETECTED VALUE
PRESENCE
ABSENCE
ELAPSED TIME
t1
t2
t3
t4
t5
T0
T1

IMAGE FORMING APPARATUS AND METHOD FOR CONTROLLING IMAGE FORMING APPARATUS

BACKGROUND OF THE INVENTION

1. Field of the Invention

The present invention relates to an image forming apparatus and an image forming method. In particular, the present invention relates to an improved technique of a process for detecting the remaining amount of developer (hereinafter, referred to as "toner").

2. Description of Related Art

In an image forming apparatus, a developing device for developing an electrostatic latent image with toner and visualizing the latent image as toner image is provided. In the image forming apparatus, a toner-supplying device for supplying the developing device with toner is equipped. The toner-supplying device temporarily stores toner which is supplied directly or from a toner bottle disposed in the image forming apparatus, in a hopper as a toner container. The toner-supplying device supplies developing device with toner through the hopper.

At the beginning of using the image forming apparatus or in case of refilling toner, toner does not have quantity of electric charge enough to form images. Therefore the density of formed image becomes uneven, which causes degradation of image quality.

As a method for making the quantity of electric charge up to the predetermined value quickly, the electrophotographic image forming apparatus for storing the total number of printing and the presence or absence of the-remaining-amount-detection signal in a read/write nonvolatile storage unit and for changing the operating condition of agitating mechanism in the hopper on the basis of the information stored in the nonvolatile storage unit is disclosed (JP-Tokukaihei-9-190078A).

In general, the presence or absence of toner is detected by a developer detector attached to the wall surface of the hopper. The developer detector is attached so that the detector plane faces toward the inside of the hopper and comes in contact with toner.

Meanwhile an agitating device agitating toner in the hopper in a cycle or at the proper timing is provided in the hopper in order to preventing retention of toner.

Many of agitating devices employ rotating mechanism that rotates in the hopper, and are constituted of mechanism that an agitating rod in which a flexible member having flexibility is provided at the end thereof rotates. The flexible member which slides on an internal surface of the hopper and moves rotationally, works as a blade for sweeping toner on the internal surface.

The above-mentioned configuration has a problem in that the flexible member slides on the detector plane of the developer detector with the rotation of the agitator, and in this sliding, there is some possibility of causing false detection of remaining amount of toner by covering the detector plane with the flexible member.

Because toner is transferred to the developing device with agitation, the level of the remaining toner declines so that the level repeatedly moves up and down by the agitation. Therefore in the case of the level near the detector plane which detects the presence or absence of toner, the detector performs detecting actions that frequent repetition of the presence or absence of toner is detected, such as the presence of toner is detected even though the absence of toner must be detected by rights, and the absence of toner is detected even though the absence of toner does not have to be detected by rights. In other words, chattering occurs in the outputted signal from the developer detector. Furthermore, the absence of toner is detected late in comparison with the actual remaining amount of toner.

The above-mentioned actions of false detection are factors that cause degradation of credibility of image forming apparatuses.

SUMMARY OF THE INVENTION

The present invention is achieved in consideration of the above-mentioned situations. An object of the present invention is to prevent the false detection of the developer detector, which is caused by the operation of the agitating device.

In order to solve the above-mentioned problem, that is, in accordance with the first aspect of the present invention, an image forming apparatus comprises:

a developing device;

a container for containing developer;

a developer detector for outputting an output signal corresponding to presence or absence of developer, the developer detector being attached to a wall surface of the container so that a detector plane faces toward inside of the container;

an agitating device for sliding on the detector plane of the developer detector and for agitating developer in the container;

a controller for controlling a movement speed of the agitating device so that a relation between rise time T0 required for rise of the output signal outputted from the developer detector and time T1 when the agitating device covers the detector plane of the developer detector meets T0>T1.

According to the first aspect of the invention, it is possible to prevent false detection of the developer detector that detects the presence or absence of developer.

The agitating device may have an agitating member, and the agitating member may slide on a detector plane of the developer detector.

According to this invention, it is possible to use an agitating member driven rotationally and sliding on the detector plane of the developer detector.

The controller may have a plurality of rotational speed patterns as speed control of the agitating device, and at least one of a plurality of the speed patterns may be a speed pattern that meets T0>T1.

According to this invention, in the case of the speed pattern that the movement speed meets T0>T1, it is possible to prevent false detection of the presence or absence of developer from the developer detector. Furthermore, by having other speed patterns, for example, it is possible to regulate the speed by selecting an optimum pattern for coverage rate in each case.

The movement speed of the agitating device may be controlled by the controller so as to meet T0>T1 when the developer detector detects the presence or absence of developer in the container.

According to this invention, it is possible to prevent false detection of the presence or absence of developer from the developer detector by making the movement speed meet T0>T1 in detecting the presence or absence of developer in the container.

The developer detector may have a piezoelectric vibration sensor.

The developer detector may have a special IC for calculating a detected value indicating the presence or absence of developer based on an output voltage value by the piezoelectric vibration sensor.

The time T1 when the agitating device covers the detector plane of the developer detector is time period while the piezoelectric vibration sensor outputs the output voltage value representing the presence of developer by sliding the agitating device.

In accordance with the second aspect of the invention, a method for controlling an image forming apparatus having a developing device, the method comprising:

outputting signal corresponding to the presence or absence of developer in a container; and agitating developer in the container by moving an agitating device so as to slide on a detector plane of a developer detector;

wherein a movement speed of the agitating device is controlled so that in the agitating, a relation between rise time T0 required for rise of the output signal outputted in the outputting, and time Ti when the detector plane of the developer detector is covered in the agitating, meets T0>T1.

According to the second aspect of the invention, it is possible to prevent false detection of the developer detector that detects the presence or absence of developer.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERED EMBODIMENTS

Hereinafter, embodiments of the present invention will be described with reference to the accompanying drawing in detail.

Figure 1:
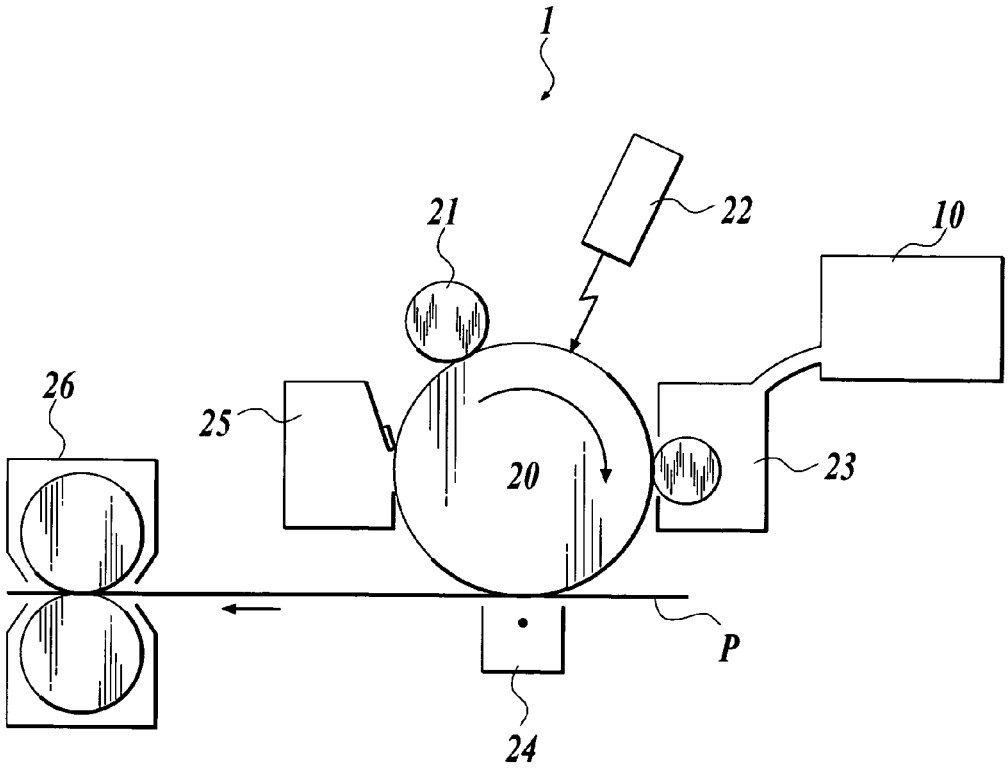
FIG. 1 is a schematic construction diagram showing an image forming apparatus 1 according to the present invention.

FIG. 1 is a schematic construction diagram showing an image forming apparatus 1 in embodiment 1 of the present invention.

In FIG. 1, the image forming apparatus 1 in the present embodiment has a photosensitive drum 20. A charging member 21 charges surface of this photosensitive drum 20 to predetermined electric potential. An exposing means 22 exposes an image and forms an electrostatic latent image on the surface of the photosensitive drum 20. The latent image is developed with toner by a developing device 23 and is visualized as a toner image. A transfer means 24 transfers the obtained toner image to a recording medium P, such as paper, that is transferred to the photosensitive drum 20. The photosensitive drum 20 that has finished the transfer of the toner image is cleaned by a cleaner 25 so as to remove residual toner on the surface remaining after the transfer. Then the photosensitive drum 20 is used for the next image forming.

The recording medium P supporting the toner image is transferred from the photosensitive drum 20 to a fixing device.26. The unfixed toner image on the recording medium is fixed by the fixing device 26. A printed image is obtained on the recording medium P.

The developing device 23 is supplied with toner through a toner feeding path from a toner supplying device 10.

Figure 2:
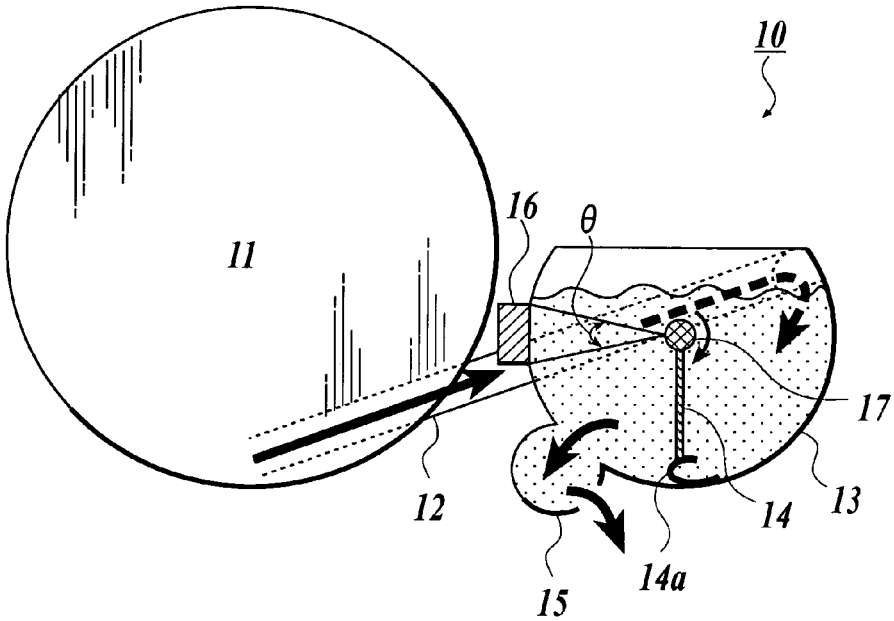
FIG. 2 is a schematic construction diagram of vertical section showing a toner supplying device 10.

FIG. 2 is a schematic construction diagram of vertical section showing the toner supplying device 10.

In FIG. 2, the toner supplying device 10 has a toner bottle containing toner disposed in a toner-bottle-installation section 11, and toner in the toner bottle transferred from the toner-bottle-installation section 11 to a hopper 13 as container for containing toner through a first toner feeding path 12. The toner transferred to the hopper 13 is agitated by an agitating rod 14 as an agitating member of an agitating device equipped in the hopper 13 in order to agitate toner. The agitated toner is supplied for the developing device 23 through the second toner feeding path 15.

The hopper 13 also has a remaining amount sensor 16 as a developer detector for detecting the presence or absence of toner in the hopper 13.

Transferring screws are equipped in the first toner feeding path 12 and the second toner feeding path 15. Toner is transferred by rotation of the transferring screw (not shown).

The agitating rod 14 maintains proper concentration and electric charge of toner transferred from the toner bottle into the hopper 13. With a flexible blade 14*a* as a flexible member made of PET sheet or the like having flexibility at the end of the agitating rod 14, the agitating rod 14 moves rotationally so as to slide on the internal surface in the hopper 13, sweeps away toner on internal surface in the hopper 13 and periodically sweeps away on the detector plane of the remaining amount sensor 16.

An agitating rod shaft 17 of the agitating rod 14 connects with a plurality of gears. The agitating rod 14 connects with an agitating motor M through the gears. The agitating rod 14 is driven rotationally by drive of this agitating motor M.

A brushless motor or a stepping motor is preferably applied to a motor used as the agitating motor M.

The remaining amount sensor 16 can be applied with a piezoelectric vibration sensor comprising a piezoelectric element (for example, piezo element or the like). The piezoelectric vibration sensor comprises the piezoelectric element equipped on the detector plane and a special IC for calculating a detected value based on an output voltage value from the piezoelectric element (not shown).

The special IC comprises a sweep generator circuit, a waveform shaping amplifier circuit, a phase detector circuit, and a digital processing circuit.

In the special IC, when the piezoelectric element is vibrating, the output voltage value becomes low, which is interpreted as "the absence of toner" by processes of the special IC. On the other hand, when the piezoelectric element is not vibrating, the output voltage value becomes high, which is interpreted as "the presence of toner" by processes of the special IC. Furthermore the special IC makes the interpreted signal pass through the digital processing circuit so as to moderate chattering caused by disturbance or the like, and outputs a detected value as a value from the remaining amount sensor 16.

Therefore until the output voltage value from the piezoelectric element is outputted as a detected value from the remaining amount sensor 16, output inverting time T0 as rise time of a output signal outputted from the remaining amount sensor 16 as a developer detector is required.

The output inverting time T0 varies with effect of material around position where the remaining amount sensor 14 is attached, and with effect of material, contact force, and the like of the agitating member.

Toner particle size is about 10 $\mu$m. Apparent specific gravity ("loose density" according to JIS) of toner particles is about 0.3 to 0.35 g/cm$^3$. Toner particles are cloud-like because of consistent agitation. The remaining amount sensor 16 outputs a detected value of "the presence of toner" or "the absence of toner" based on a signal generated when this cloud-like toner particles come in contact with the detector plane, or the toner particles in contact with the detector plane break off.

However, a signal of the presence of toner is also outputted faultily from the remaining amount sensor 16 when the flexible blade 14*a* of the agitating rod 14 passes so as to slide on the detector plane of the remaining amount sensor 16. A signal of "the presence of toner" is detected faultily at each cycle of rotation of the agitating rod 14. Therefore, for implementation of the present embodiment, a rotational speed of the agitating rod 14 is set so that sliding time T1 as time wherein the flexible blade 14*a* of the agitating rod 14 comes into contact with an end of the detector plane of the remaining amount sensor 16, passes sliding on the detector plane, and breaks away from the other end of the detector plane, that is, time wherein the tip (the end of the flexible blade 14*a*) of the agitating device (the agitating rod 14) covers the detector plane of the developer detector (the remaining amount sensor 16), is shorter than the output inverting time T0.

It is allowed that the sliding time T1 does not include time of passage through such a position where the output value representing "the presence of toner" is not outputted practically, as the position where the flexible blade 14*a* begins to come into contact with the detector plane of the remaining amount sensor 16, and the position where the flexible blade 14*a* is close to break away from the other end of the detector plane, and that the sliding time is regarded as only time of passage through positions where the output value representing "the presence of toner" is outputted practically.

Figure 3:
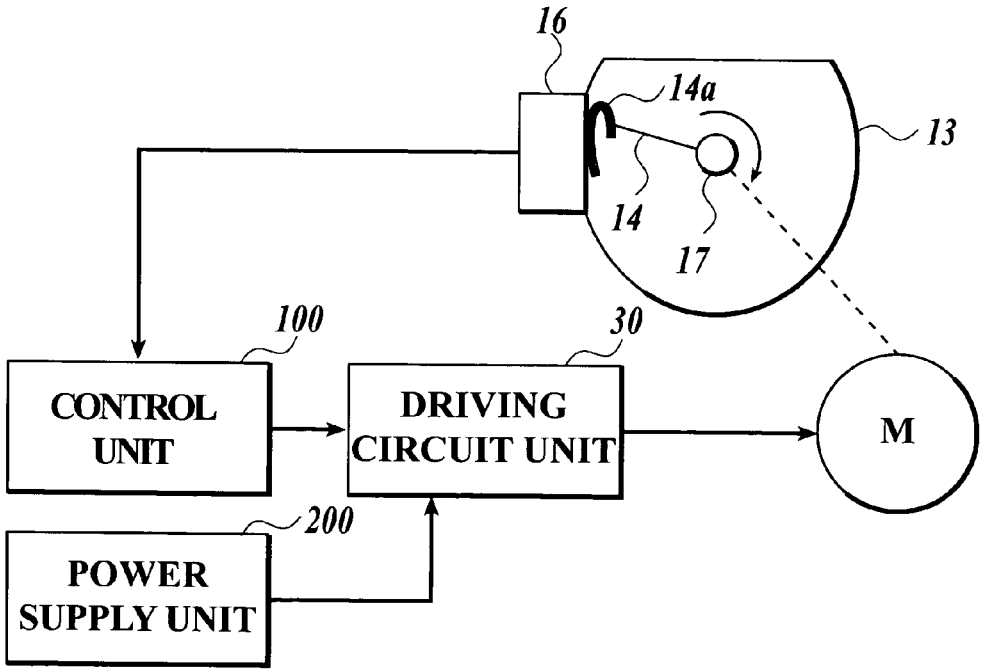
FIG. 3 is a control block diagram showing an agitating rod 14.

FIG. 3 is a control block diagram showing an agitating rod 14.

In FIG. 3, a driving circuit unit 30 drives the agitating motor M based on a signal from a control unit 100. The agitating motor M is connected to the agitating rod 17 through the gears and the agitating rod 14 is driven rotationally. The agitating motor M is supplied with power from a power supply unit 200.

The agitating rod 14 driven rotationally agitates toner in the hopper 13.

The control unit 100 comprises a CPU (Central Processing Unit), a RAM (Random Access Memory), a ROM (Read Only Memory), and a memory unit. The control unit 100 loads programs or data stored in the ROM or the memory unit (not shown) into such a temporary storage area (not shown) as the RAM, performs various processes, such as control of the whole of the image forming apparatus 1 and directives to each unit, based on the relevant program, and gets the image forming apparatus 1 to work.

For implementation of the present embodiment, the memory unit stores Start/Stop signal to start and stop the agitating motor M, CLK signal to specify a plurality of rotational speeds on changing gear, and the like. At least one of a plurality of the rotational speed patterns of the agitating motor M is set so that sliding time T1 is shorter than the output inverting time T0 of the remaining amount sensor 16.

In the case of determination of the presence or absence, the agitation rod 14 is driven rotationally at the rotational speed set so that the sliding time T1 is shorter than the output inverting time T0 of the remaining amount sensor 16.

It is possible to calculate the output inverting time T0 from specification such as circuit constants of the special IC provided for the remaining amount sensor 16.

It is possible to calculate the sliding time T1 using the following equation based on a sliding angle θ centered on the agitating rod shaft 17 of the agitating rod 14, the angle being formed by the flexible blade 14*a* of the agitating rod 14 from coming into contact with an end of the detector plane to breaking away from the other end with a slide, and the rotational speed N of the agitating rod 14.

$$T1=(\theta/360)\times(N/60)[s] \quad (1)$$

θ: sliding angle (degree)

N: rotational speed (rpm)

The control unit 100 may be a control unit inherent in the toner supplying device 10. The control unit 100 may be also connected with each unit in the image forming apparatus so as to enable to send and receive various kinds of information each other and be included in a control unit for receiving information from each unit, for interpreting the information, for outputting movement directives and the like resulted from interpretation to each unit, and for controlling each unit.

The driving circuit unit 30 is provided with an encoder in order to detect the number of revolution of the agitating motor M and a drive control unit in order to detect difference between the number of revolution of the agitating motor M and directing frequency according to the CLK signal from the control unit 100 and corrects the number of revolution of the agitating motor M. The driving circuit unit 30 performs start and stop of the agitating motor M based on the Start/Stop signal from the control unit 100, and controls the number of revolution of the agitating motor M or the rotational speed based on the CLK signal.

The driving circuit unit 30 may be what is peculiarly provided for the agitating motor M and may be what is included in the control unit 100.

Start and stop control, and acceleration and deceleration speed control of the agitating motor M are performed by the driving signal from the driving circuit unit 30. Driving force is transmitted to the agitating rod shaft 17 in the toner supplying device 10 through a plurality of the gears, and the agitating rod 14 is driven rotationally.

Figure 4A:
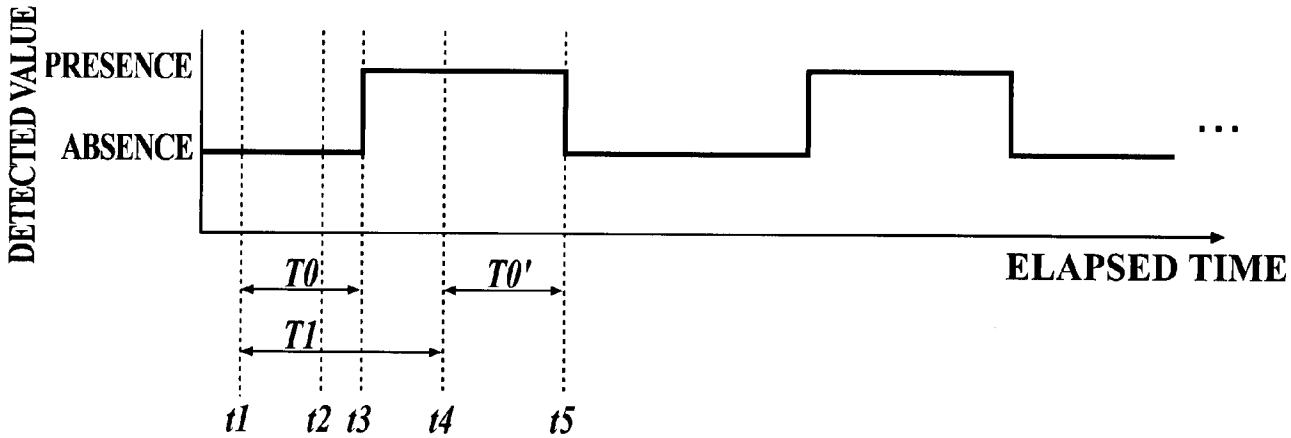
FIG. 4A is a time chart showing a detected value outputted from an earlier remaining amount sensor according to an earlier development.
Figure 4B:
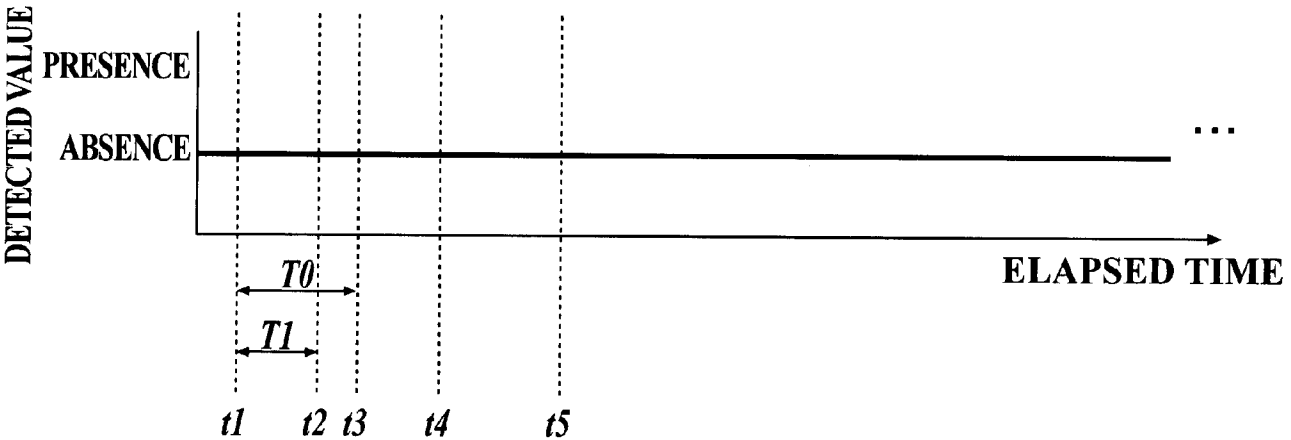
FIG. 4B is a time chart showing a detected value outputted from a remaining amount sensor 16 of the present invention.

FIGS. 4A and 4B are time charts showing outputted values from the remaining amount sensor 16 in the case that the level of remaining toner in the hopper 13 is under the detector plane determining the presence or absence of remaining toner (that is, in the case of the absence of toner).

FIG. 4A shows a detected value outputted from the remaining amount sensor of an image forming apparatus according to an earlier development satisfying the output inverting time T0< the sliding time T1. FIG. 4B shows a detected value outputted from the remaining amount sensor 16 of the image forming apparatus of the present invention satisfying the output inverting time T0> the sliding time T1.

Firstly an example of the earlier image forming apparatus will be described below for comparison with the earlier.

In FIG. 4A, at time t1 when the flexible blade 14*a* of the agitating rod 14 comes into contact with an end of the detector plane of the remaining amount sensor 16, the piezoelectric element on the detector plane outputs a voltage value corresponding to "the presence of toner". However, because processing of the voltage value by the special IC does not finish yet at this time, the detected value as output of the remaining amount sensor 16 remains a value representing "the absence of toner".

The special IC in the remaining amount sensor 16 starts to perform the processing of the voltage value from the detector plane based on the voltage value from the piezoelectric element on the detector plane.

At time t3 after the lapse of the inverting time T0 from time t1, the processing of the voltage value by the special IC finishes, and the detected value as output from the remaining amount sensor 16 becomes a value representing "the presence of toner".

At time t4 when the flexible blade 14*a* breaks away from the other end of the detector plane of the remaining amount sensor 16 (after the lapse of the sliding time T1 from time t1), a voltage value corresponding to "the absence of the toner" is outputted from the piezoelectric element on the detector plane. Also at this time, the detected value as output of the remaining amount sensor 16 remains a value representing "the presence of toner" yet.

The special IC in the remaining amount sensor 16 starts to perform processing of the voltage value from the detector plane based on the voltage value from the piezoelectric element on the detector plane.

At time t5 after the lapse of output inverting time T0' (T0>T0') from time t4, the processing of the voltage value by the special IC finishes, and the detected value as output from the remaining amount sensor 16 becomes a value representing "the absence of toner".

Secondly, it will be described in the image forming apparatus relating to the present invention.

In FIG. 4B, at time t1 when the flexible blade 14*a* of the agitating rod 14 comes into contact with an end of the detector plane of the remaining amount sensor 16, the piezoelectric element on the detector plane outputs a voltage value corresponding to "the presence of toner".

The special IC in the remaining amount sensor 16 starts to perform processing of the voltage value from the detector plane based on the voltage value from the piezoelectric element on the detector plane.

In the present invention, the flexible blade 14*a* of the agitating rod 14 passes so as to slide on the detector plane for the sliding time T1 that is shorter than the output inverting time T0.

At time t2 after the lapse of the sliding time T1 from time t1, the flexible blade 14*a* of the agitating rod 14 breaks away from the other end of the detector plane of the remaining amount sensor 16.

At this time, a voltage value corresponding to "the absence of toner" is outputted from the piezoelectric element on the detector plane.

By generating the voltage value corresponding to "the absence of toner" in time that is shorter than the inverting time T0, also at time t3 after the lapse of the output inverting time T0 from time t1, the detected value as output from the remaining amount sensor remains the value representing "the absence of toner".

That is, while the special IC is performing processing of the voltage value, the flexible blade 14*a* breaks away from the detector plane of the remaining amount sensor 16. Consequently, the detected value as output from the remaining amount sensor 16 accordingly remains the value representing "the absence of toner" without changing from the value representing "the absence of toner" to the value representing "the presence of toner". Change of the detected value does not occur.

Consequently in the present invention, because of setting the rotational speed of the agitating rod 14 so that the sliding time T1 is shorter than the output inverting time T0, "the presence of toner" gets not to be detected at each cycle of rotation of the agitating rod 14 in the case of "the absence of toner". Detecting "the presence of toner" in spite of the case that "the absence of toner" must be detected by rights is preventable. It does not occur that "the absence of toner" is detected late in comparison with the actual remaining amount of toner. The action of false detection like the earlier is not caused. It is possible to prevent degradation of credibility of image forming apparatuses.

In the present embodiment, the aspect to drive rotationally the agitating rod 14 as an agitating device is described. However, without limiting agitating means to the rotational drive, for example, an aspect of agitating toner due to reciprocation of an agitating member driven by a rotary screw is allowed. In the case of the aspect like this, the reciprocating member is provided with a flexible blade for sliding on-the detector plane of the remaining amount sensor.

This entire disclosure of Japanese Patent Applications No. Tokugan 2003-200351 filed on Jul. 23, 2003 is incorporated herein by reference in its entirety.

What is claimed is:

1. An image forming apparatus comprising:

a developing device;

a container for containing developer;

a developer detector for outputting an output signal corresponding to presence or absence of developer, the developer detector being attached to a wall surface of the container so that a detector plane faces toward inside of the container;

an agitating device for sliding on the detector plane of the developer detector and for agitating developer in the container;

a controller for controlling a movement speed of the agitating device so that a relation between rise time T0 required for rise of the output signal outputted from the developer detector and time T1 when the agitating device covers the detector plane of the developer detector meets T0>T1.

2. The apparatus of claim 1, wherein the agitating device comprises an agitating member, and the agitating member slides on the detector plane of the developer detector.

3. The apparatus of claim 1, wherein the controller has a plurality of rotational speed patterns as a speed control of the agitating device, and at least one of a plurality of the patterns of speed is a pattern of speed that meets T0>T1.

4. The apparatus of claim 1, wherein the movement speed of the agitating device is controlled by the controller to meet T0>T1 when the developer detector detects the presence or absence of developer in the container.

5. The apparatus of claim 1, wherein the developer detector comprises a piezoelectric vibration sensor.

6. The apparatus of claim 5, wherein the developer detector comprises a special IC for calculating a detected value indicating the presence or absence of developer based on an output voltage value by the piezoelectric vibration sensor.

7. The apparatus of claim 6, wherein the time T1 when the agitating device covers the detector plane of the developer detector is time while the piezoelectric vibration sensor outputs the output voltage value representing the presence of developer by sliding the agitating device.

8. A method for controlling an image forming apparatus having a developing device, the method comprising:

outputting signal corresponding to the presence or absence of developer in a container; and agitating developer in the container by moving an agitating device so as to slide on a detector plane of a developer detector;

wherein a movement speed of the agitating device is controlled so that in the agitating, a relation between rise time T0 required for rise of the output signal outputted in the outputting, and time T1 when the detector plane of the developer detector is covered in the agitating, meets T0>T1.

* * * * *